US009162235B2

(12) United States Patent
Morgan et al.

(10) Patent No.: US 9,162,235 B2
(45) Date of Patent: Oct. 20, 2015

(54) SPRAY NOZZLE SEAL MEANS

(75) Inventors: Sean Morgan, Victoria (AU); Stuart Morgan, Victoria (AU)

(73) Assignee: Spray Nozzle Engineering Pty. Limited, Mentone, Victoria (AU)

( * ) Notice: Subject to any disclaimer, the term of this patent is extended or adjusted under 35 U.S.C. 154(b) by 0 days.

(21) Appl. No.: 13/378,793

(22) PCT Filed: Jun. 17, 2010

(86) PCT No.: PCT/AU2010/000747

§ 371 (c)(1),
(2), (4) Date: Mar. 6, 2012

(87) PCT Pub. No.: WO2010/144960

PCT Pub. Date: Dec. 23, 2010

(65) Prior Publication Data

US 2012/0153577 A1 Jun. 21, 2012

(30) Foreign Application Priority Data

Jun. 17, 2009 (AU) ..... 2009902786

(51) Int. Cl.

| | |
|---|---|
| ***B05B 1/00*** | (2006.01) |
| ***B05B 1/02*** | (2006.01) |
| ***B05B 15/06*** | (2006.01) |
| ***B05B 1/34*** | (2006.01) |

(52) U.S. Cl.

CPC ... *B05B 1/02* (2013.01); *B05B 1/00* (2013.01); *B05B 1/3436* (2013.01); *B05B 15/065* (2013.01)

(58) Field of Classification Search

CPC ..... B05B 1/00; B05B 1/02; B05B 15/065; B05B 1/3436; F02M 61/1853; Y10S 239/04

USPC ..... 239/589, 596, 600, 601, DIG. 4, DIG. 8; 175/67, 340; 451/102

See application file for complete search history.

(56) References Cited

U.S. PATENT DOCUMENTS

| | | | | |
|---|---|---|---|---|
| 4,936,512 | A * | 6/1990 | Tremoulet, Jr. | 239/596 |
| 4,991,778 | A | 2/1991 | Maas et al. | |
| 5,199,640 | A * | 4/1993 | Ursic | 239/596 |
| 6,394,366 | B1 | 5/2002 | Adams | |
| 6,488,221 | B1 * | 12/2002 | McDonald | 239/596 |
| 7,510,131 | B2 * | 3/2009 | Geskin et al. | 239/600 |
| 7,806,349 | B2 * | 10/2010 | Noelle | 239/589 |

FOREIGN PATENT DOCUMENTS

| | | | |
|---|---|---|---|
| GB | 180387 | A | 5/1922 |
| WO | 2010144960 | A1 | 12/2010 |

OTHER PUBLICATIONS

International Search Report; PCT/AU2010/000747 dated Aug. 17, 2010.

International Preliminary Report on Patentability; PCT/AU2010/000747 dated Dec. 20, 2011.

(Continued)

*Primary Examiner* — Steven J Ganey

(74) *Attorney, Agent, or Firm* — TraskBritt, P.C.

(57) ABSTRACT

The invention is a sealing means in a spray nozzle assembly which includes the provision of a groove adapted to at least partially accommodate a sealing means such as an O-ring in the surface of an upper face of an orifice disc said face being directed towards a lower face of an inner periphery of a nozzle cap.

5 Claims, 2 Drawing Sheets

(56) References Cited

OTHER PUBLICATIONS

Chambers Science and Technology Dictionary, 1988, p. 256.

Dictionary, P.R. Collier, Inc, 1986, p. 292, London and New York.

Merriam-Webster.com, n. d. Web. Nov. 5, 2014. http://www.merriam-webster.com/dictionary/disk.

* cited by examiner

SPRAY NOZZLE SEAL MEANS

CROSS-REFERENCE TO RELATED APPLICATIONS

This is a national phase entry under 35 U.S.C. §371 of international Patent Application PCT/AU2010/000747, filed Jun. 17, 2010, published in English as International Patent Publication WO 2010/144960 A1 on Dec. 23, 2010, which claims the benefit under Article 8 of the Patent Cooperation Treaty to Australian Patent Application Serial No. 2009902786, filed Jun. 17, 2009.

AREA OF THE INVENTION

This invention relates to the area of spray nozzles and means for sealing these when in use. In particular the invention relates not only to an improved sealing means but to such a means which is compact without compromising the internal strength of the nozzle components.

BACKGROUND TO THE INVENTION

Spray nozzle type devices customarily consist of a nozzle body extending from a fluid inlet end to a fluid outlet end the interior of which body defines a central bore housing, among other possible components, a swirl device and an orifice disc.

It is well known for an outlet face of the orifice disc to abut a landing defined by an inner periphery of the nozzle cap about a central bore and to be provided with a seal between the disc and cap.

In the prior art it has been known to provide a compressive seal at the front of the nozzle, between the inner housing and the orifice disc, using a fiat washer seal.

Such a washer seal does not provide for particularly reliable sealing at elevated pressure and temperature, with the flat seal likely to be squeezed out of the mating surfaces under some conditions.

Other types of sealing means are used in spray nozzle assemblies for example a new system has been developed which uses two independent O ring seals in compression (as opposed to a common axial body seal coupled with a front compressive seal) to form the pressure containing function for the entire nozzle assembly, whereby one O ring resides at the front of the assembly within the nozzle cap, and provides a seal between the orifice disc and the inner nozzle cap housing, and the other seal exists at the rear sealing face of the nozzle cap housing where it engages the face of the housing body via a screwed mechanism, forming the final seal.

This new sealing method allows for much higher pressure ratings than were possible with the prior art.

A further improved sealing method used in the prior art is an O ring seal groove situated inside the inner cap housing within the lower periphery of the nozzle cap, designed to conform to known sealing gland dimension standards, and allowing for correct sealing between the orifice disc and the inner cap housing. This arrangement however reduces the pressure retaining wall thickness between the inner depth of the o-ring groove and the outer surface of the housing, whose outer profile form is restricted by the need to prevent impeding the emitted spray from the orifice disc, thus compromising the mechanical strength of the housing itself.

In this prior art, the nozzle disc typically abuts a single radial mating surface inboard of the O-ring groove in the nozzle cap, with the outer diameter of the orifice disc being free and unsupported at the outer O-ring groove, which is flush with the accommodating diameter of the disc housing bore and larger In diameter than the orifice disc due to normal clearance requirements.

This typical arrangement provides little mechanical support for the compressive forces required to create an adequate face to face seal without gaps. Also, when such required compressive forces are applied, a bending moment is applied to this radial mating surface inboard of the O-ring groove, placing a bending stress upon the thinner area between the outer face of the component housing the seal groove, and the innermost O-ring groove depth, which can result in failure of this innermost radial mating surface, and in worst case scenarios, cause this entire middle section to push outward and fracture away. Thus this arrangement is not conducive to high pressure operation.

A method used to reduce the need for an O-ring groove in the inner cap, was to simply use an O-ring in compression, much like the flat washer, and not provide any sealing grooves for the proper sealing of the parts. In this case a cavity is provided between the disc and the housing cap. This variation has distinct pressure limitations where the sealing cavity formed conforms to no known sealing conventions.

OUTLINE OF THE INVENTION

It is an object of this invention to provide a seal arrangement which either ameliorates or removes the above sealing limitations in spray nozzles.

The invention is a sealing means in a spray nozzle assembly which includes the provision of a groove adapted to at least partially accommodate a compressible material in an upper face of an orifice disc said face being directed towards a lower face of an inner periphery of a nozzle cap.

It is preferred that the resultant seal conform to known sealing gland standards.

It is further preferred that the compressible material be an O-ring.

It is also preferred that the orifice disc used in the invention be manufactured from tungsten carbide.

It is further preferred that due to the brittle nature of the tungsten carbide, armour means be used to reinforce the orifice disc, thus further limiting the risk of failure at the O-ring groove within a typically brittle nozzle disc.

In order that the invention may be more readily understood we shall describe by way of non limiting example a particular embodiment of the invention with reference to the accompanying diagrams.

BRIEF DESCRIPTION OF THE DRAWING FIGURES

BRIEF DESCRIPTION OF AN EMBODIMENT OF THE INVENTION

Figure 1:
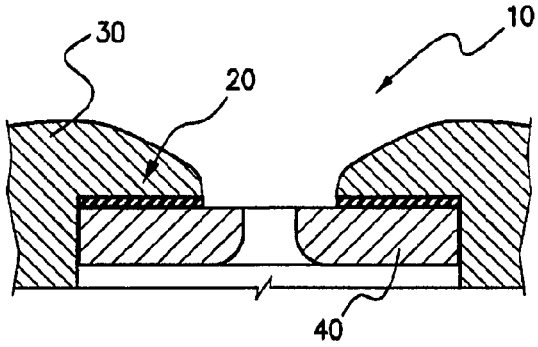
FIG. 1 (Prior Art)
FIG. 1 Shows a prior art flat disc sealing means.

In a preferred embodiment of the invention 10 a sealing means 20 is provided within a spray nozzle assembly in a recess 50 below an upper face 41 of an orifice disc 40 and a lower face 31 of an inner periphery of a nozzle cap 30.

The sealing means of the invention is a compressible material such as an 0 ring located in a groove 50 located within the upper face 41 of the orifice disc facing the lower face 31 of the inner periphery of the nozzle cap.

The arrangement is such that tightening of the cap 30 of the nozzle assembly to the nozzle body causes compressive sealing by the O-ring. The resultant seal is designed to conform to known sealing gland standards.

Figure 3:
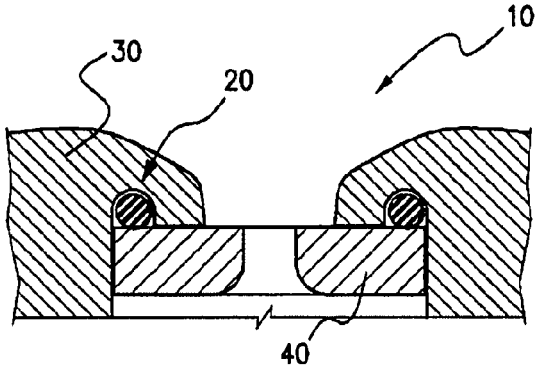
FIG. 3 (Prior Art)
FIG. 3 Shows a prior art O-ring seal located in a groove in the nozzle retaining cap.

By locating the O-ring within a groove 50 in the orifice disc rather than the inner periphery 60 of the nozzle cap as shown in FIG. 3 the peripheral flange is consequently stronger than the excised peripheral flange of FIG. 3 and is able to withstand higher internal pressures.

Figure 5:
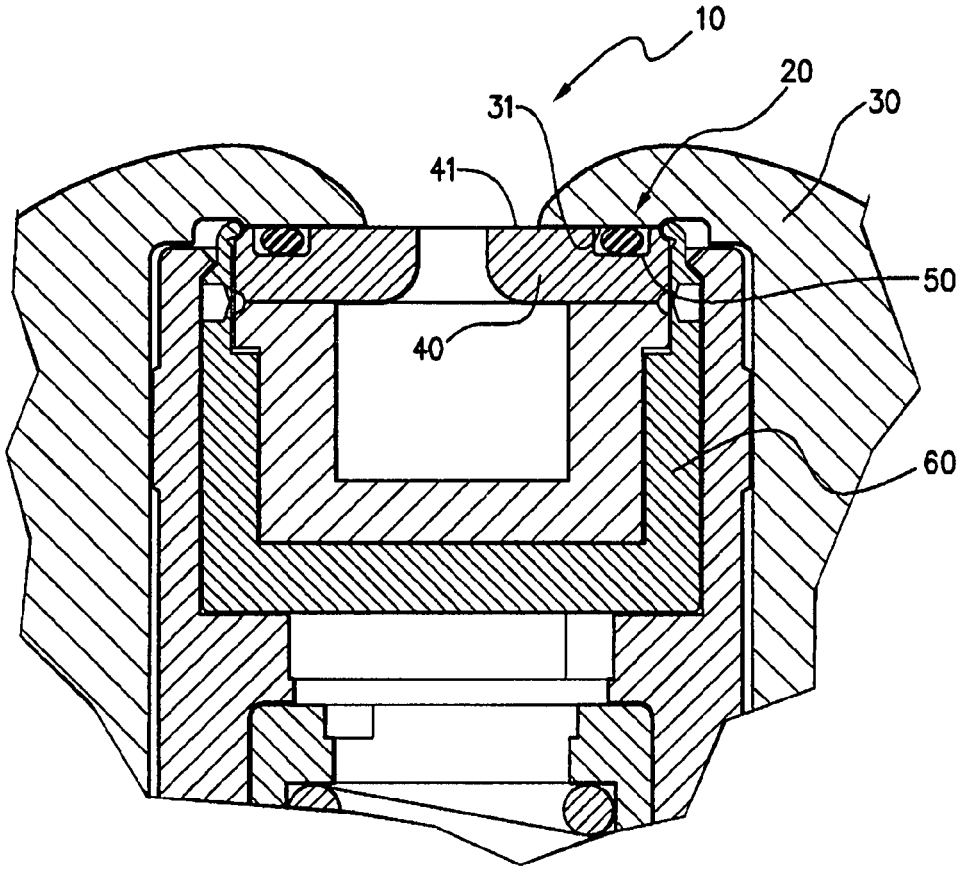
FIG. 5 Shows the O-ring seal of the invention associated with an orifice disc provided with armour means.

The orifice disc used in the invention is however preferably manufactured from tungsten carbide which is brittle and the presence of the groove tends to reduce its strength. For this reason it is preferred that armour means 60 as shown in FIG. 5 be used to reinforce the orifice disc, thus limiting the risk of failure at the O-ring groove within a typically brittle nozzle disc. The invention is however not restricted in this regard.

The provision of a groove residing within the orifice disc itself is most novel, and allows for the thicker wall thickness of the cap housing, and increased pressure retaining characteristics, whilst satisfying typical sealing conventions and standards.

Figure 2:
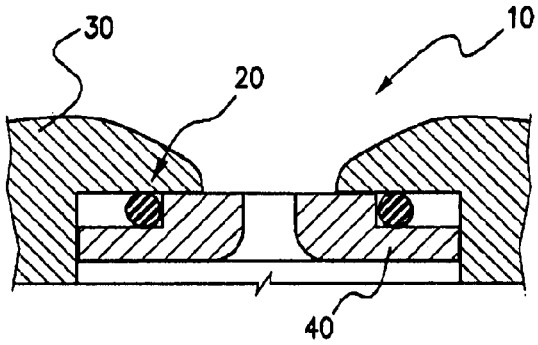
FIG. 2 (Prior Art)
FIG. 2 Shows a prior art O-ring seal without a housing groove.

As discussed earlier the use of an O-ring seal in a relatively fitted groove in either the nozzle cap or the orifice disc provides a stronger and better arrangement than the seals shown in FIGS. 1 and 2. The provision of a groove in the nozzle cap periphery does act to weaken the cap in this area.

Figure 4:
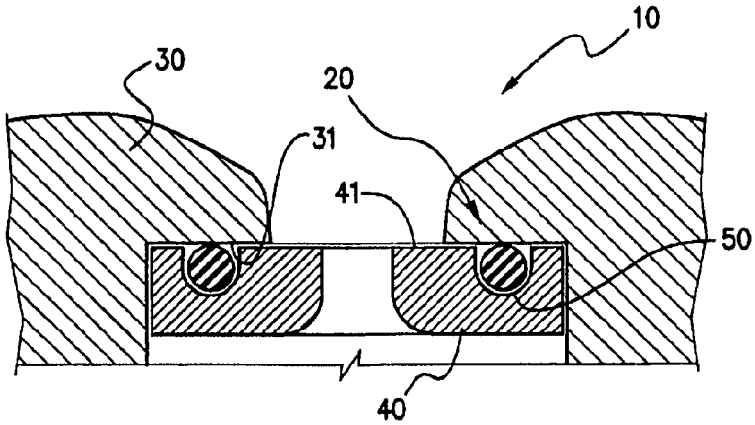
FIG. 4 Shows the O-ring seal of the invention located in a groove in an upper face of the orifice disc.

The invention as shown in FIG. 4 provides a significant added benefit in enclosing the seal groove cavity with two radial sealing faces each side of the radial groove. The preferred form of the invention, provides that not only is the O-ring groove eliminated from the nozzle cap, but also provides a significant addition of strength to the overall design of the nozzle cap allowing for far greater pressure excursions.

The invention differs from the prior art particularly in the respect described above as well as the differences from the prior art detailed above, the invention is however not restricted as to the type of materials used or the appearance and shape of its component parts and while we have described herein one particular embodiment of the invention it is to be understood that variations and modifications in the materials used and the features described can still lie within the scope of the invention.

The claims defining the invention are as follows:

1. A seal arrangement in a spray nozzle assembly comprising:

a nozzle cap; and an orifice disc formed from tungsten carbide, the orifice disc comprising;

a groove adapted to at least partially accommodate a compressive seal in the surface of an upper face of the orifice disc, the upper face being directed towards a lower face of an inner periphery of the nozzle cap, the groove being located substantially radially inwardly form the edge of the upper surface of the orifice disc; and armor configured to reinforce the orifice disc, the armor comprising an annular ring extending around an external periphery of the orifice disc.

2. The seal arrangement of claim 1, wherein the armor comprises an upper inwardly extending flange that rests on a beveled upper edge of the orifice disc.

3. The seal arrangement of claim 1, wherein the inner periphery of the nozzle cap forms a thickened flange wall able to withstand high internal pressures.

4. The seal arrangement of claim 1, wherein the groove in the orifice disc is, in cross section, substantially rectangular with radiused lower corners.

5. The seal arrangement of claim 4, wherein the compressive seal is an O-ring.

* * * * *